US009189908B2

(12) United States Patent
Sampson et al.

(10) Patent No.: US 9,189,908 B2
(45) Date of Patent: Nov. 17, 2015

(54) HAND-HELD PROJECTILE DISPENSER

(71) Applicants: Kwasi D. Sampson, Atlanta, GA (US); Gary R. McGowan, Ellenwood, GA (US)

(72) Inventors: Kwasi D. Sampson, Atlanta, GA (US); Gary R. McGowan, Ellenwood, GA (US)

( * ) Notice: Subject to any disclaimer, the term of this patent is extended or adjusted under 35 U.S.C. 154(b) by 77 days.

(21) Appl. No.: 14/164,119

(22) Filed: Jan. 24, 2014

(65) Prior Publication Data

US 2014/0217111 A1 Aug. 7, 2014

Related U.S. Application Data

(60) Provisional application No. 61/759,524, filed on Feb. 1, 2013.

(51) Int. Cl.

| | |
|---|---|
| ***B65H 37/00*** | (2006.01) |
| ***G07D 11/00*** | (2006.01) |
| ***B65H 1/06*** | (2006.01) |
| ***B65H 3/06*** | (2006.01) |
| ***B65H 3/56*** | (2006.01) |

(52) U.S. Cl.

CPC ..... *G07D 11/0021* (2013.01); *B65H 1/06* (2013.01); *B65H 3/063* (2013.01); *B65H 3/56* (2013.01); *B65H 2551/15* (2013.01); *B65H 2701/1912* (2013.01)

(58) Field of Classification Search

CPC ..... B65H 37/005; B65H 35/002; B65H 35/0026; B65H 35/0033; B65H 37/007; B65H 35/0046; G07D 11/0021

USPC ..... 221/185

See application file for complete search history.

(56) References Cited

U.S. PATENT DOCUMENTS

| | | | | |
|---|---|---|---|---|
| 3,191,588 | A * | 6/1965 | Thew | 124/27 |
| 3,920,979 | A * | 11/1975 | Kilby et al. | 708/106 |
| 4,682,721 | A * | 7/1987 | Duchin | 227/67 |
| 4,884,992 | A * | 12/1989 | Grimes | 453/29 |
| 5,107,734 | A | 4/1992 | Armbruster | |
| 5,335,816 | A * | 8/1994 | Kaufman et al. | 221/13 |
| 5,513,773 | A | 5/1996 | Cargill | |
| D386,404 | S | 11/1997 | Kirk, III et al. | |
| 5,843,551 | A | 12/1998 | Lee et al. | |
| RE36,143 | E | 3/1999 | Kind et al. | |
| 6,299,018 | B1 * | 10/2001 | Kimbrell | 221/71 |
| 6,394,306 | B1 * | 5/2002 | Pawlo et al. | 221/2 |
| 7,121,499 | B2 * | 10/2006 | Lammers et al. | 242/588.6 |
| 2003/0029741 | A1 | 2/2003 | Wells | |
| 2007/0102471 | A1 * | 5/2007 | Gross et al. | 227/131 |
| 2010/0059540 | A1 | 3/2010 | Sipler | |
| 2013/0312722 | A1 | 11/2013 | Price | |
| 2014/0165985 | A1 | 6/2014 | Bryngelson | |

OTHER PUBLICATIONS www.Themoney-gun.com website, linked to InstaGram page, showing the development timeline for a currency dispensing apparatus.

* cited by examiner

*Primary Examiner* — Patrick Mackey

(74) *Attorney, Agent, or Firm* — Baxam Law Group, LLC; Deanna L. Baxam

(57) ABSTRACT

A projectile dispenser apparatus used as a novelty device to aim and rapidly dispense multiple pieces of materials such as currency at a target under the exclusive actuation and control of the user.

14 Claims, 9 Drawing Sheets

FIG. 7
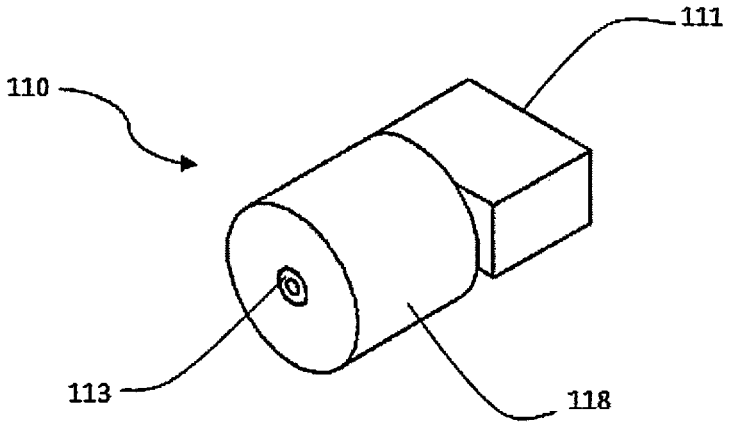
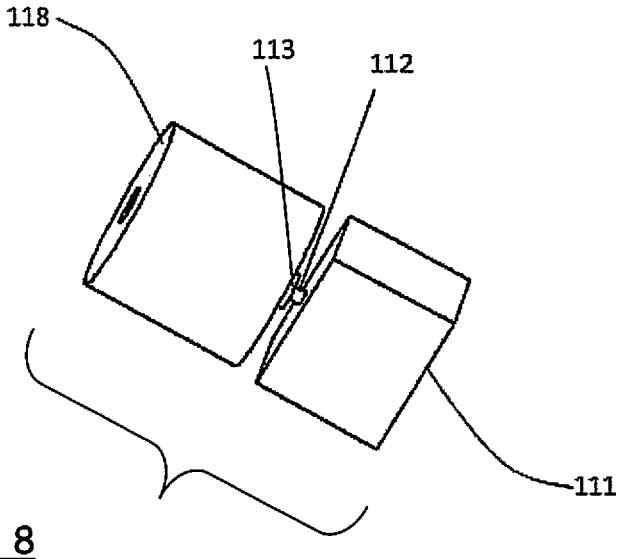
FIG. 8

HAND-HELD PROJECTILE DISPENSER

This application claims the benefit of priority from U.S. Provisional Patent Application No. 61/759,524, filed Feb. 1, 2013.

TECHNICAL FIELD OF THE INVENTION

The technology described herein relates to the field of novelty entertainment or promotion. More specifically, the invention is a novelty item used to dispense small bills of paper or other lightweight materials, such as currency notes, novelty bills, large confetti, coupons and the like. Furthermore, this technology relates to a method of dispersing bills and other dispensable materials using a hand-held, manually activated and controlled projectile dispenser apparatus that provides rapid and wide dispersion of the bills in the direction toward which the projectile dispensing apparatus is pointed.

BACKGROUND OF THE INVENTION

Apparatus for dispensing materials from rolls in controlled fashion are known. For example, desktop adhesive tape dispensers provide a means for extending a piece of tape from a roll to the desired length and then severing the piece of tape so removed. Automatic teller machines (ATM) and similar apparatus have been developed to measure and dispense currency of particular denominations. The customer seeking to withdraw from an ATM controls the amount of currency to be dispensed based on their selection of a specific withdrawal amount, but this type of dispensing action is not within the user's control. These technologies do not contemplate or address the need for a hand-held dispensing apparatus for dispersing stacked currency bills or similarly shaped planar materials in a rapid-dispensing process which can be accomplished by pointing the apparatus at a desired target and actuating a dispensing mechanism.

SUMMARY OF THE INVENTION

The invention comprises an apparatus which ejects from an orifice, by projectile means, dispensable materials such as individual pieces of paper, lightweight materials or flat, planar objects. The apparatus includes a storage compartment with an opening to load and dispenses its contents. The apparatus further includes a handle that allows the user to hold, control, point and manipulate the apparatus to dispense the contents. The apparatus further includes a mechanism to start and stop the dispensing of items from inside the apparatus. This mechanism may be attached to or be remotely located separate from the apparatus, allowing the dispensing action of the apparatus to be activated from a distance by the user. A projectile dispenser apparatus for rapidly dispensing bills comprises a base including a dispensing slot, a storage compartment comprised of front, rear and side panels, and a lid comprised of front and side lid edges; wherein the dispensing slot traverses the front panel; and wherein the upper edges of the side front and rear panels form an opening of the storage compartment that engages with the lid at an angle beneath the upper edges of the side panels of the storage compartment wherein the front and side lid edges move from a position above the upper edges of the side panels to a position below the upper edges of the side panels; a dispensing element comprised of at least one movable dispensing element housed within the base, a motor assembly and a power source; wherein the at least one movable dispensing element, upon activation of the motor assembly, consecutively engages with the surface bill of a stack of bills in the storage compartment and moves it in a forward trajectory toward the dispensing slot such that the bill is dispensed in a projectile manner from the dispensing slot; and a handle located beneath the base which houses the power source, with an actuation means for activating the motorized dispensing element; wherein engagement of the actuation means activates the motor assembly and initiates the motion of the movable dispensing element, to dispense the bills from the dispensing slot.

In one embodiment, the invention comprises a base further including a dispensing slot, a storage compartment comprised of two side panels, a front panel, a rear panel and a lid; wherein the dispensing slot traverses the front panel and wherein the side panels are connected to each of the front panel and rear panel at an angle to form the storage compartment, the upper edges of the side front and rear panels forming an opening of the storage compartment. The storage compartment may further be subdivided into internal compartments, for example a tray for holding the dispensable materials. The base further includes an activatable dispensing element comprised of at least one movable dispensing element housed within the base, a motor assembly and a power source; wherein the at least one movable dispensing element, upon activation of the motor assembly, consecutively contacts and engages with the exposed surface of a bill from a stack of bills in the storage compartment and moves that bill, and subsequent bills with which it comes in contact, in a trajectory toward the dispensing slot such that one or more bills are simultaneously dispersed from the dispensing slot. The invention further comprises a handle with an actuation means that is manually controlled, such as a switch or a trigger for activating the motorized dispensing element; wherein engagement of the actuation means actuates an electrical circuit which initiates a flow of electricity that activates the motor and further initiates the movement of the motorized dispensing element.

In various exemplary embodiments, the technology of the invention includes a handheld projectile dispenser apparatus with a projectile dispensing feature that is actuated by engagement or depression of a switch located on the handle of the device. Alternatively, the switch is provided as a trigger means connected to or located on the handle of the device.

In other embodiments, the dispenser apparatus includes a movable dispensing element comprised of a roller, series of rollers, movable foot or drive belt which is in direct contact with a stack of bills in the storage compartment of the base. The movable dispensing element has a tactile surface which allows it to engage in rapid sequence with the surface of the outermost bill (for example the lowermost bill in a configuration having the bills stacked above the movable dispensing element) in a stack of bills to be dispersed, and to move each of the bills contacted and engaged by the movable dispensing element in linear fashion along a trajectory from the receptacle to the dispensing slot of the base. In this manner, a large number of bills can be dispensed in rapid profusion, i.e. "rained" from the dispensing slot of the apparatus.

In certain embodiments, the invention comprises an electrical motor, which when actuated by closure of an electrical circuit, directly or indirectly enables the movement of the movable dispensing means to eliminate the dispensed material from the device. In these embodiments, activation of the actuation means closes the electrical circuit, resulting in a flow of current to a movable element that generates the movement of the movable dispensing means.

In an embodiment of the invention a square or rectangular storage compartment or an alternatively shaped structure configured to hold the bills to be dispensed may be employed as a feature of the base.

In certain embodiments the actuation means comprises a safety which, when the actuation means is in the inactivated position traverses the dispensing slot of the base to prevent unintended dispersal of the contents. When the actuation means is activated, the safety is recessed from traversing the dispensing slot, thereby allowing free egress of the contents.

In other embodiments, the technology of the invention provides a method of rapid-fire dispensing of currency bills in a desired projectile direction as determined by the user, the method further comprising modulating the rate of dispensing and the flow of bills being dispensed by increasing or decreasing manual pressure on the actuation means.

In yet another embodiment, the invention provides a method of rapid-fire dispersion of coupons, promotional bills, advertisements, business cards and the like in a desired projectile direction as determined by the user.

According to another embodiment of the invention there is provided a method of dispensing currency bills and other planar dispensable materials by a user of an apparatus according to the invention as is herein claimed.

BRIEF DESCRIPTION OF THE DRAWINGS

FIG. 7 is an isometric view of a motor assembly according to an embodiment of the invention.

FIG. 8 is an exploded view showing the relationship of a roller element to the motor assembly according to one embodiment of the invention.

DETAILED DESCRIPTION OF CERTAIN EMBODIMENTS

In preferred embodiments, the invention is used as a hand-held novelty item to distribute a stack of bills or other dispensable materials in a manner completely controlled and directed by the user. As used in this application, the terms "bills" or "dispensable materials" means currency bills, bank notes, coupons, fliers or other stacked pieces of thin material made of pliable material such as paper or plastic. The unique construction, design and function of the apparatus provides a hand-held means for dispensing bills rapidly in projectile fashion by aiming and pointing the dispensing slot of the apparatus in a desired direction, then actuating the dispensing means to provide a rapid and continuous release of bills in targeted fashion. For example, a power source may be engaged by activating a switch to initiate and sustain the dispensing action, the release of bills continues until the power source is disengaged, for example by stopping depression of the switch.

Figure 1:
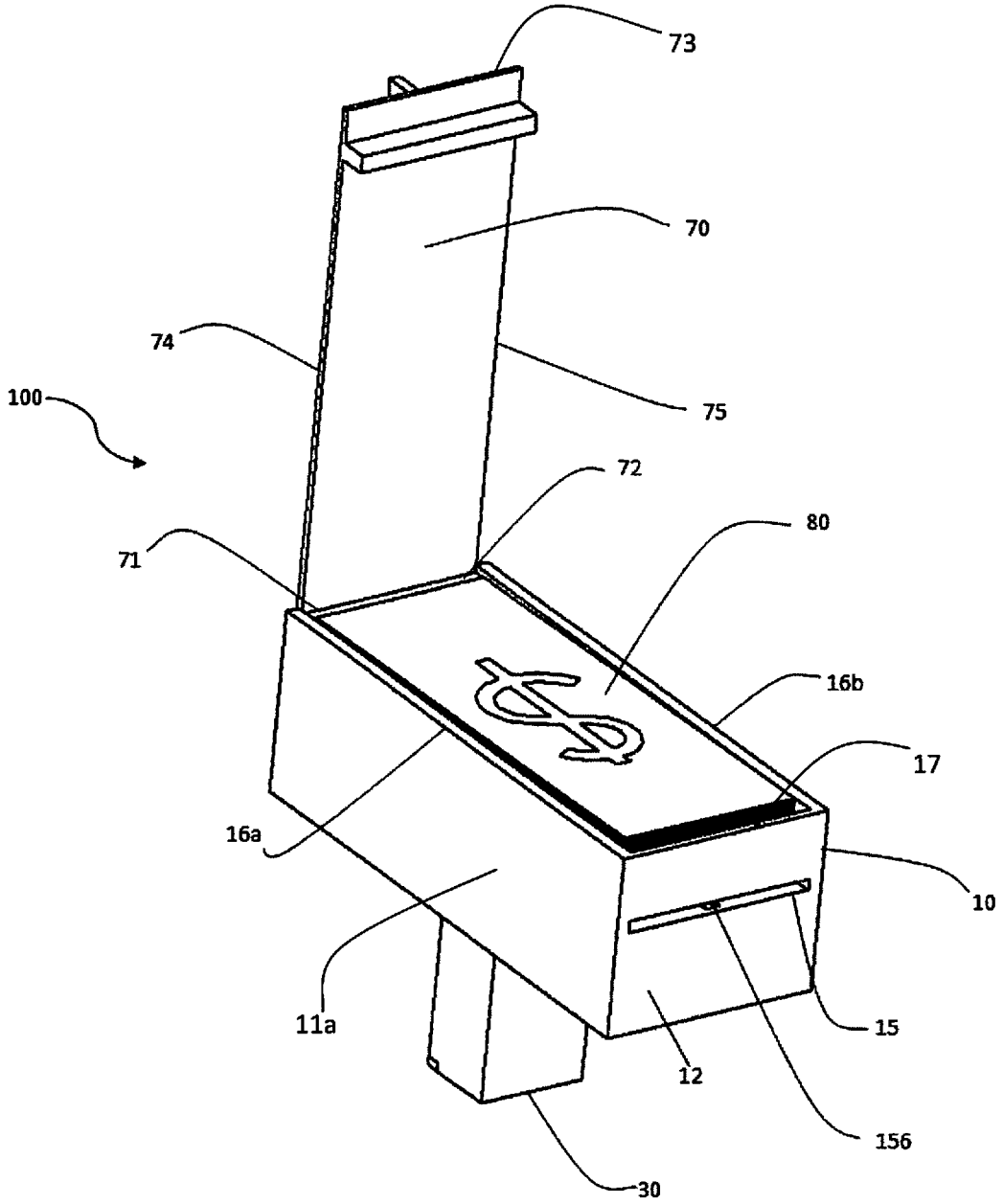
FIG. 1 is an isometric view of one embodiment of the invention for dispensing currency and novelty bills with the lid of the storage compartment of the base open displaying currency notes.

As seen in FIG. 1, the body of the apparatus of the invention 100 may in certain desired embodiments be constructed of plastic or another lightweight material that allows for less weight to be carried by the user and for economic manufacture. However, the apparatus may also be constructed of other materials, depending on the intended use. Non-limiting examples of other materials that may be used for the construction are aluminum, steel, wood, composites or even cement. The base assembly forms the bulk of the apparatus to which the handle and other components are connected. These other components may be attached to the base by screws, nuts, adhesive or other attachment means, or combinations thereof, provided the attachment means does not compromise the functionality of the apparatus. One section of the base 10 comprises a dispensing tray for holding the bills 80 that are to be dispensed from the apparatus. Also included in the base are a storage area for an electric motor and other parts of the movable dispensing assembly, such as a roller (shown in subsequent figures), multiple rollers, movable feet or a drive belt.

The base 10 of the apparatus of the invention, as demonstrated in FIG. 1, may have the external configuration of an angled container, such as a rectangle or square, however in other embodiments the base is not limited as to its shape. In the exemplary embodiment of FIG. 1, the base is formed with two parallel and opposed side panels 11*a*, 11*b*, each having an exposed side panel edge 16*a*, 16*b* at the top thereof. The container is further formed with a front panel 12 defined by an exposed front panel edge 17 at the top thereof, and a horizontally disposed dispensing slot 15 across all or part of the width of the front panel 12. The dispensing slot 15 preferably is of dimensions suitable to accommodate the dispensable material 80 to be passed through it in planar fashion without folding or wrinkling. The base further includes a rear panel 13 and a lower base panel 19 that forms the bottom and underside of the base (both shown in FIG. 2). The side panels and front and rear panels of the base compartment may be beveled, curved or otherwise shaped or designed for aesthetic purposes without compromising the functionality of the apparatus. The panels of the base, the internal compartments and features and the handle element may be molded or formed in segments that may be attached together by conventionally known fastening means, such as adhesive or screws, to form the apparatus.

Figure 2:
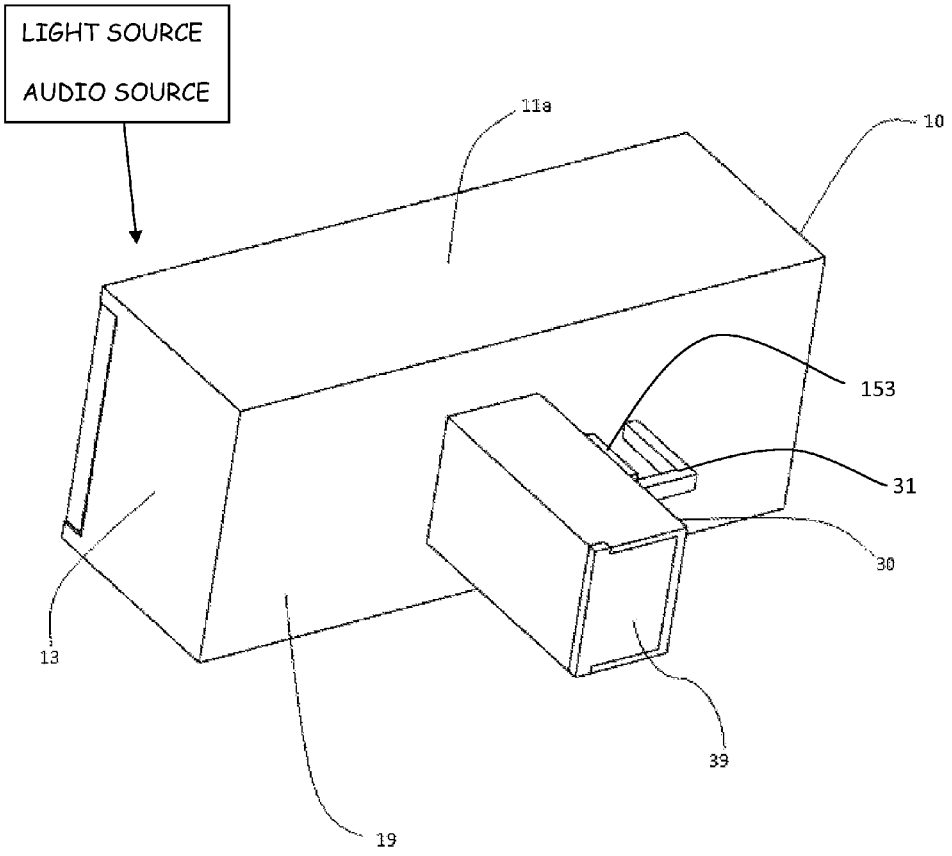
FIG. 2 is an isometric view of the underside of a device according to an embodiment of the invention.

FIG. 2 displays an embodiment of the invention showing the handle and the switching or actuation means for the apparatus configured as a trigger with a guide 31 configured around the switch 153. The handle 30 is connected as a detachable part to the underside of the base 19 by conventional means, for example adhesive, screws or as an integrally molded piece. It may also be molded together with the base. In this version of the apparatus, a battery compartment is provided in the handle via an opening 39.

One or more panels of the base compartment further include attachment means, such as areas for application of adhesive, screw type fasteners, or nuts and bolts, and holes or tabs therefor, to attach and stabilize the movable dispensing element and the electric motor within the base 10.

Figure 3:
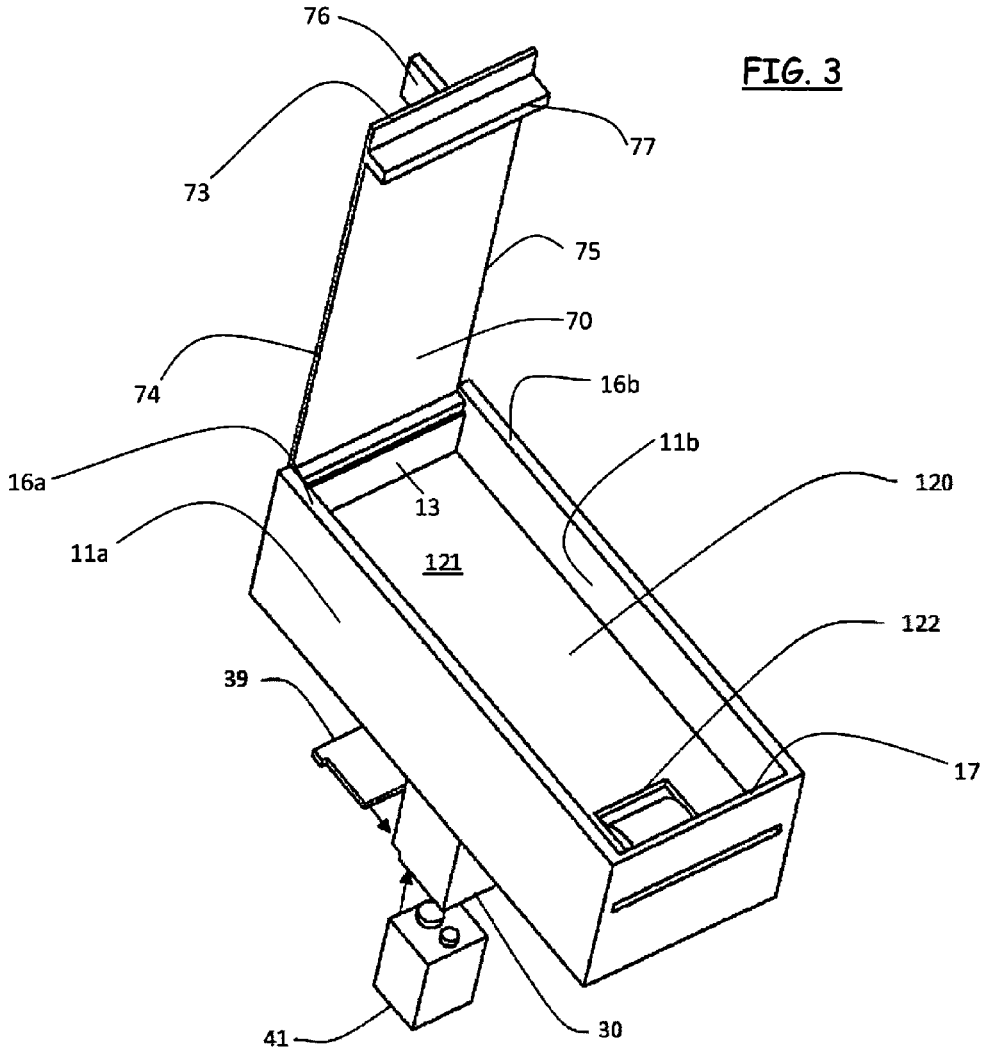
FIG. 3 is an isometric view of an embodiment of the invention showing the relationship of a lid element to the storage compartment of the apparatus.

A lid that opens and closes to allow insertion of the bills or other materials to be dispensed may be removably attached to the top edge of the rear panel 13 of the base compartment. As shown in FIG. 3, the lid 70 opens about an approximately 90 to 180 degree axis. Lid 70 further comprises lid edges 73, 74, 75 for engaging with or beneath the edges 16*a*, 16*b* of the storage compartment 10. The lid 70 is connected at the base thereof to the top edge of rear panel 13, in certain embodiments by tab closures connected to the side panels by a rod or dowel, or by spring-type or spring-loaded hinges (not shown). Torsion springs may be included at the attached end of the lid 70 in order to add spring force to the closure mechanism. The hinges may be of conventional formations used as closure means. As further shown in FIG. 3, the exterior surface of lid 70 may further include a tab or grip 76 for moving lid 70 to and from the closed position.

A handle 30 is attached to the base 10 using screws and nuts, adhesives or other suitable attachment means. In the switch and trigger-activated versions of the invention, two wires are attached to the positive and negative connector posts of the power source, for example using soldering iron and solder. This wiring of the electrical circuit is done right before or after the following steps. The handle 30 may be permanently attached, for example as a contiguously molded feature, or it may be formed as a detachable element that is may be attached and removed to the underside of the base. For example, the handle may be formed as an integral rechargeable battery pack that may be removed and plugged in to a wall outlet for recharging.

Figure 4:
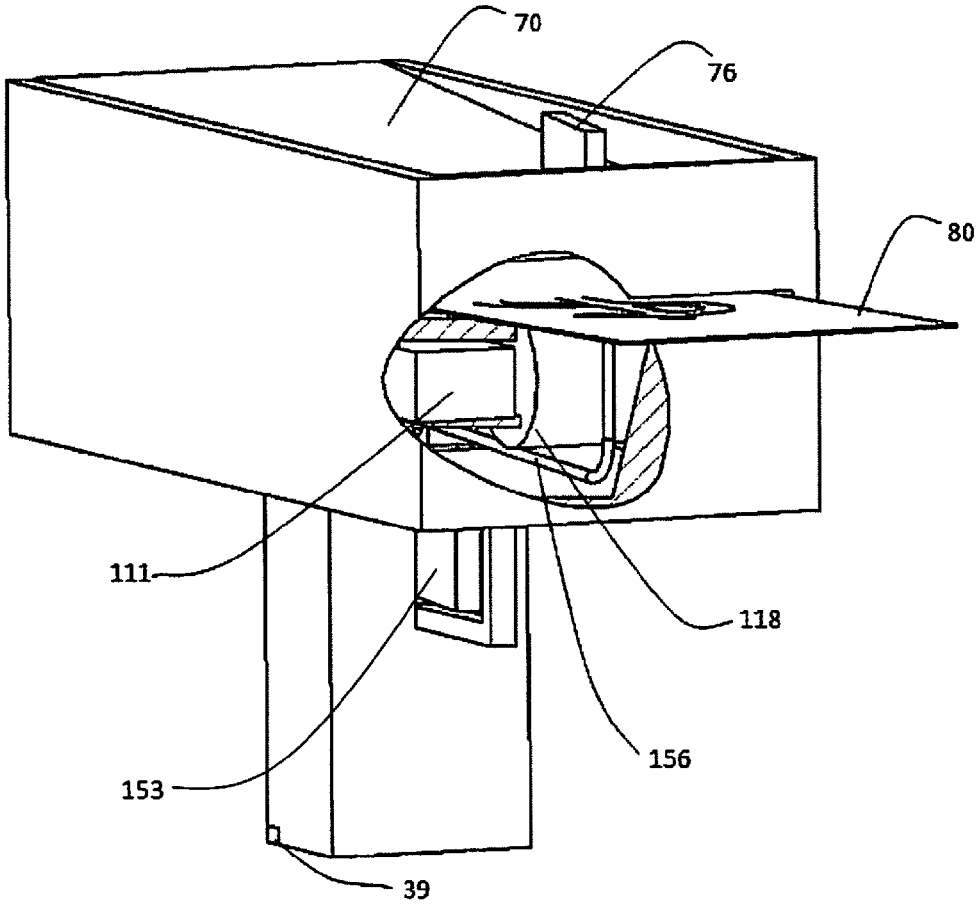
FIG. 4 is a partial section view through a front corner of the device according to one embodiment of the invention.

As shown in FIG. 4, a push-button switch may be incorporated in the handle 30. An industrial adhesive is used to secure the push-button switch 153 into a cutout in the handle 30. The soldering of the connecting wires for the electrical circuit, if not done already, can be completed after the switch is fully installed. A nine volt battery is installed into the handle to be used as the device power source. Once the batteries are inserted into the battery compartment at one end of the connecting post, then the cover of the battery compartment 39 is attached to secure the batteries in the device.

In certain embodiments, the mechanism used to start or stop the dispensing of items from inside the apparatus is a push-button switch 153 (FIG. 4). A trigger assembly which includes a finger guide 31 over the switch to allow greater flexibility in manipulation and user control may also be included. Other mechanisms which allow controlled start and stopping of rapid dispensing of multiple bills toward a target may additionally be used. Other assemblies beside the switch or trigger which enable the completion of the electrical circuit may be used. Other components may also be added to the electrical circuit to improve the functionality, novelty or overall use of the device for its intended purposes.

Figure 5:
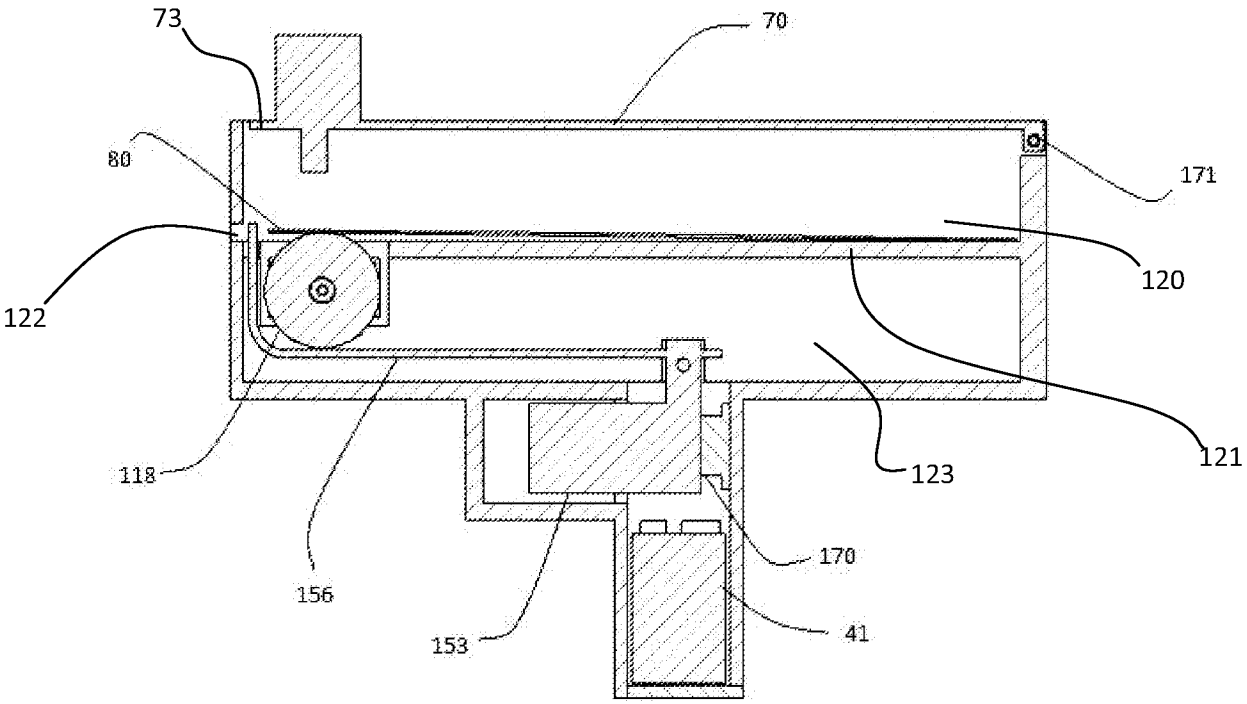
FIG. 5 is a transverse sectional view of an apparatus according to the invention showing the movable dispensing means in relation to the dispensable materials in the storage compartment.
Figure 6:
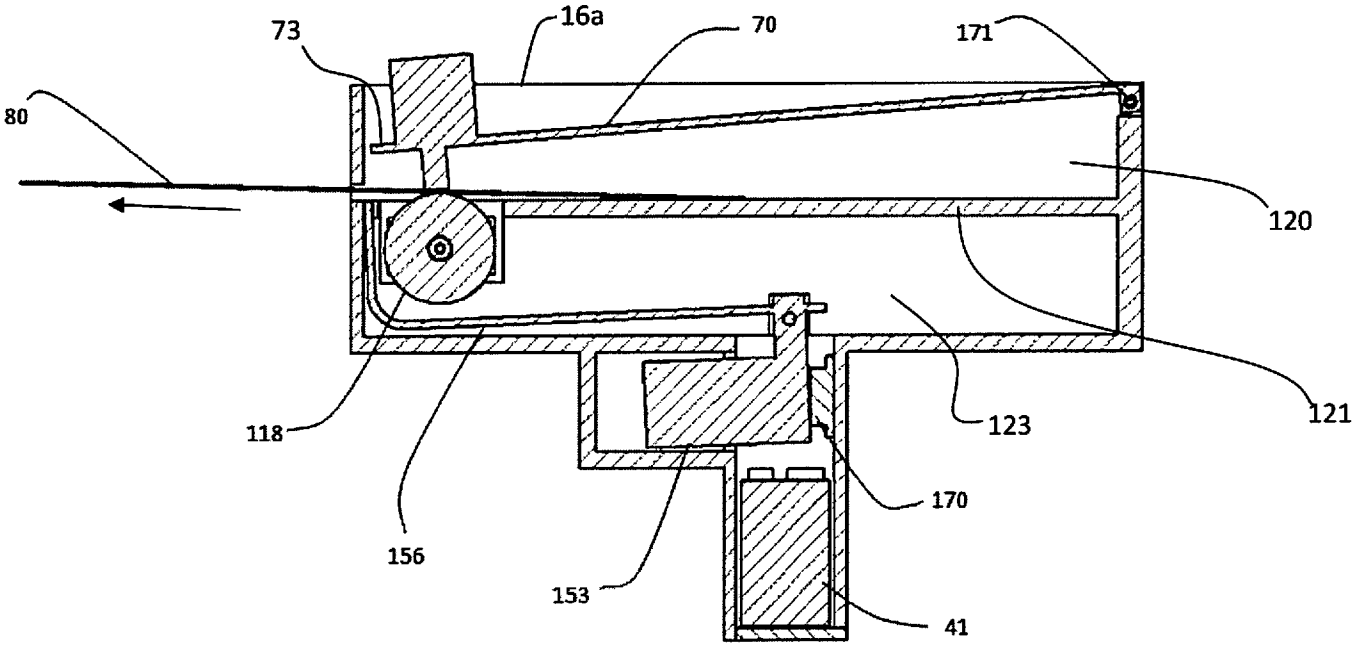
FIG. 6 is a transverse sectional view of an embodiment of an apparatus according to the invention showing the dispensing of the dispensable material according to the operation of the apparatus and the method of the invention.

According to the embodiments of FIGS. 5 and 6 the lid secures the closure of the storage compartment. The lid may engage at the level of the side edges of the base 10 or it may engage beneath the side edges, for example using a click lock engagement feature. As shown in FIG. 6, the lid engages with the surface of the stack of dispensable materials within the storage compartment. In this respect, the front edge 73 of the lid 70 may engage and lock in place beneath the level of the side panel edges 16*a* (shown) so that it rests on and touches the topmost bills in a stack of bills 80. The planar surface of the lid is thus disposed at an angle beneath the top edges of the base. Depending on the thickness of the stack and number of bills inserted, the lid 70 may be elevated upward so that it engages co-planar with the side panel edges of the storage compartment by click locking in place. It should also be recognized that if the movable dispenser assembly is positioned in the bottom region of the base compartment, then the lid will hold the stack of inserted bills in place so that the roller contacts and feeds the lowermost bill in the stack toward and through the dispensing slot. This configuration may be reversed to provide the stack of dispensable materials in the lower compartment with the roller assembly above it, in which case the roller will contact and engage the uppermost bill in the stack in sequential manner during operation of the device.

It should further be recognized that while it can desirably be used to keep the materials to be dispensed from falling or being flipped out of the storage compartment, the lid 70 may be omitted altogether from the apparatus, and a clip, lever or other means employed within the storage compartment to hold the stack of materials in place.

With respect to the movable dispensing assembly, there is included, for example in the embodiments shown in FIGS. 5, and 6 a roller, which may be made of rubber or other skid or slip resistant tactile surface that allows engagement with the surface of the materials to be dispensed. The roller is in direct contact with the surface of the loaded stack of dispensable materials. As shown in the non-limiting example of FIGS. 5 and 6, the roller 118 is positioned in a sub-chamber 123 beneath the dispensing tray 120 of base 10. The surface of the roller 118 protrudes slightly through a slot 122 disposed in the bottom panel 121 of the dispensing tray 120. It is to be understood that movable means other than a single roller, such as a series of rollers or movable feet or drive belts may be used. These movable elements may be disposed in an upper compartment or in a lower compartment, depending on the various configurations of the apparatus for receiving the dispensable material. The roller can be held in place via a rod or dowel connected to a movable element of the motor such that when the motor turns such a movable element, it contacts and causes rotation of the roller. As the roller turns, its surface, which is contact with the dispensable material, moves the dispensable material in the direction of the rotation (FIG. 6).

As shown in FIGS. 7 and 8, the movable dispensing assembly 110 may include an electric motor 111 with a rotating shaft 112 which is turned by the electric motion of the motor 111. The shaft 112 is inserted within the motor to engage with one or more gears (not shown) which facilitate the turning motion. The shaft 112 may optionally be stabilized by a washer means (not shown) to assist engagement of the post with a roller 118. A sleeve 113 may also be placed over the shaft 112 to allow any gaps in diameter between the post and the roller 118 to be eliminated or reduced, thus ensuring a tight fit between the roller and the post that preserves the momentum of the rotational action when the roller is rotated in relation to the shaft 112. The roller 118 may be secured to the shaft 112, or over the sleeve 113, as appropriate, with an adhesive, for example an industrial adhesive. It should also be understood that the roller may be configured to fit snugly within a compartment formed to accommodate it within the housing of the base. In some embodiments, one or more gears may be included between the motor and roller(s) or motor and the drive belt or other movable elements. The entire assembly comprising the motor, shaft and roller can be attached to the base using an industrial adhesive or other attachment means, for examples, screws, nuts or bolts, and oriented toward the dispensing slot as shown in FIGS. 5 and 6. As discussed above, in certain embodiments, the rubber roller and electric motor assembly are located below the storage compartment.

In the operation of the apparatus according to a preferred embodiment (see e.g. FIG. 6), a battery power source 41 is located within the handle 30 of the apparatus. The motor 111 rotates a rubber roller 118. The rubber roller engages with the items 80 in the dispensing tray 120 and pushes them out of the dispensing slot with projectile force. The amount of and the rate at which the contents of the dispensing tray are projectile dispensed is controlled by the user. Increased and prolonged depression of the switch or trigger increases and sustains the projectile thrust of the materials from the apparatus. When the user releases or turns off the switch mechanism the motor stops rotating the rubber roller and the projectile dispensing of materials stored in the compartment is slowed and eventually stopped.

It is contemplated that embodiments of the invention may be made that include more than one roller element arranged in opposed, parallel configuration or in series one behind the other to further facilitate the forward projectile movement of the bills toward the dispensing slot. The same multiple element configurations may be incorporated with two or more movable feet or drive belts, used alone or in combination with one or more rollers.

Figure 9:
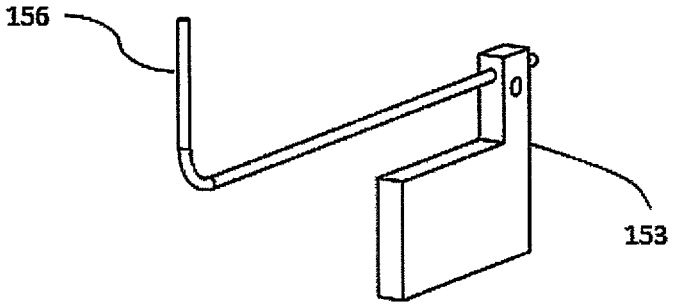
FIG. 9 is perspective view of a safety means according to an embodiment of the invention.

A safety 156, as shown in more detail in FIG. 9, is disposed, in some embodiments of the invention, within the base across the dispensing slot. The safety 156 comprises a single formed or segmented shaft having an end that is angled to protrude across the opening of the dispensing slot, and at the other end to be relatably and movably connected to the switch 153. When the switch is activated, for example by depressing its surface, the resulting movement of the switch causes a corresponding movement of the safety to withdraw it from across the opening of the dispensing slot as the motor, roller and dispensing action are activated. In the embodiment shown, the end of the safety 156 that relates to the switch 153 is deflected at an angle in relation to the axis of the switch as it is withdrawn from the opening of the dispensing slot.

The apparatus further comprises an electrical circuit, which consists of a switch mechanism (push-button, trigger or other actuation means) that closes the circuit, a battery power source, and an electrical motor. This simple electrical circuit or more complex variations thereof may be used. For example, a speed control element such as a potentiometer may be added to further control the rate of dispensing beyond manual control which is possible with the simple circuit. Additionally the switch mechanism may be modified to provide pulse control such that, for example, when the switch is activated the motor engages enough to rotate the roller a desired number of revolutions, e.g. 1-3 revolutions, then stops. In this way, an additional level of user control is incorporated. The motor may be continuously activated by continuous engagement of the switch means to provide nonstop revolutions, which allows for continuous rapid dispensing; or, alternatively, the circuit may be modified to allow the circuit to remain in the closed position until it is desired to terminate the dispensing action. In the latter respect, continuous depression or user engagement with the actuating switch would not be required.

Figure 10:
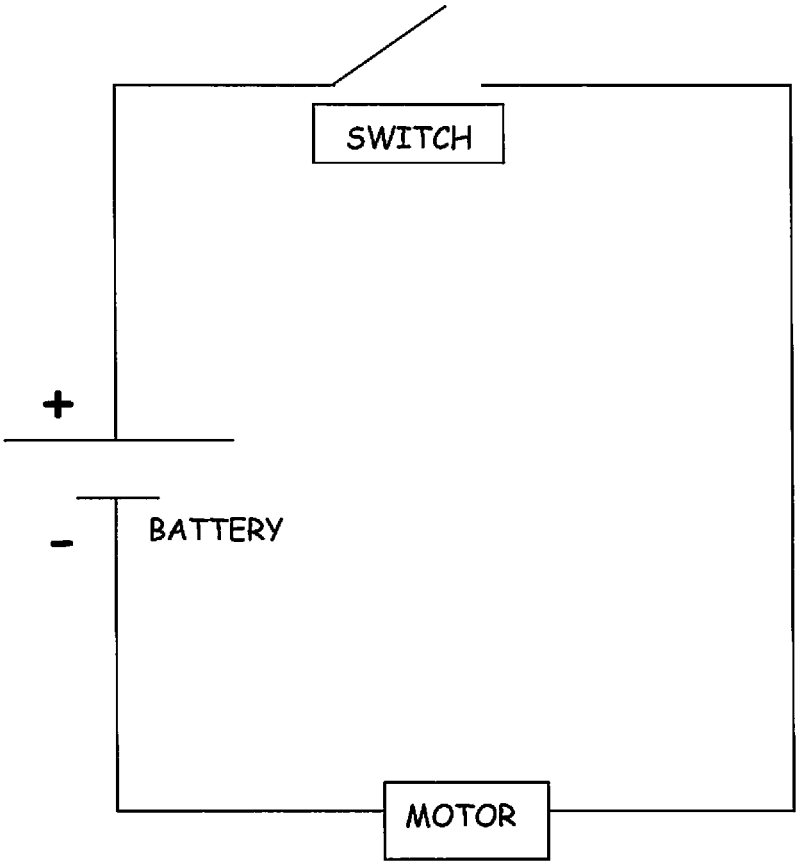
FIG. 10 is a schematic flow diagram showing an exemplary layout of the electrical circuit used by the power source of the invention.

According to the embodiment of FIG. 10, an electrical circuit is provided which provides electricity from a power source to the motor. The circuit is formed by adding one wire to each of a pair of connector posts within the motor (not shown). The wires may be connected for example using a soldering iron and solder. The other end of each wire is connected to the corresponding positive and negative end of the terminals of batteries which serve as the power source. The terminals for the batteries are located in battery compartment within the handle. The battery compartment may have an opening for loading battery cells on the underside of the handle, as shown in FIGS. 3 and 7, or a side-load opening. As batteries, a nine volt battery is used. Differently sized batteries, such as class AA, or rechargeable batteries may also be used. Alternate fuel sources or other more compact battery sources with longer fuel life and which can generate enough electricity to power the motor, such as nickel-cadmium or lithium ion based batteries, may be used. The power source can also be located outside the base and handle of the device as long it can generate the electricity to power the motor. The battery compartment cover of the handle can be omitted in an alternate construction of the handle if a removable, rechargeable battery pack configured as a handle that can be attached to the base is also used.

In operation, the apparatus of the invention allows the users to load a stack of paper, dollar bills, coupons, promotional flyers and the like into the storage compartment. The lid is closed and depending on the number of bills inserted, is engaged in direct contact with the surface of the stack of bills. The lid is closed by clicking it into place with or beneath the side panel edges of the storage compartment. The user may then point the apparatus in a desired direction, for example at a person or toward a group of persons, and activate the switch to turn on the apparatus. Engagement of the switch closes the electrical circuit between the battery power source and the motor, and initiates the flow of electricity from the battery to the motor. The electric impulses begin the rotation of the motor, which in turn rotates the shaft to which the roller is connected. As the roller, the surface of which is in contact with a surface of the stack of bills, begins to turn, its surface creates a frictional shift of the bill with which it is in contact with the roller and the bill is propelled toward the dispensing slot of the storage compartment. As the bill moves forward, the next bill comes in contact with the roller such that it is immediately rolled forward right behind and sometimes almost simultaneously with the first bill that is being ejected. This process is repeated for as long as the switch is turned on and the electrical circuit is generating energy to the motor. In this manner, a rapid succession of bills is ejected from the apparatus. In this way, the novelty feature of the apparatus is heightened as it generates excitement among the recipients of the bills, for example if money is being dispensed into a crowd.

The size of the materials to be dispensed will determine the number of revolutions of the roller, or turns of a drive belt or repetitive motions of a movable foot, that are required to dispense the material from the storage compartment. The weight and surface gloss of the materials selected to be dispensed may also be a factor. Larger, heavier items or those with a high level of surface gloss may require more revolutions of the roller to be dispensed. The surface of the roller or other moving element may also be modified to improve its grip and reduce slippage in the contact with the material being dispensed.

If the components of the device are positioned and manufactured correctly it can be used to collect the items it dispenses by reversing the drive of the motor. In this respect the motor may include a switch to reverse the drive action.

The device of the invention many be used to dispense paper currency and items of the same size, and other any materials that may be fit into the storage compartment. The size of the storage compartment may also be adjusted or adjustable stops inserted within the storage compartment, for example as tabs (not shown) so that the size of the materials may be adjusted. In this manner, for example, the device could be used to dispense playing cards which are of smaller size than currency notes, or different sized currency notes may be accommodated.

Other optional features which may be included in the apparatus of the invention include light features, for example LED lights, that are also powered by actuation of the electrical circuit and cause parts of the apparatus to light up while it is in use. Various audio features can be added to enhance the excitement of the action of the apparatus by generating one or more sounds upon activation of the power source. Colors, branding and logos can also be added on the exterior surfaces, and the external shape of the device can be conformed to resemble various objects, characters and figures.

INDUSTRIAL APPLICABILITY

The invention has applicability for entertainment purposes. The device can for example be used to dispense items for advertising purposes, such as promotional handbills, flyers and coupons. The device may also be used to dispense dollar bills and other valid currency, or novelty money. Novelty applications of the device, for example, include the rapid dispersion of currency bills at parties or entertainment events, or dispersion of coupons or promotional handbills into the crowd at a sporting event. The device of the invention may further be used to dispense materials for the purpose of creating art, for example colored papers and confetti for the purpose of creating montages or three-dimensional artistic works.

The invention claimed is:

1. A projectile dispenser apparatus for rapidly dispensing bills comprising:

a. a base including a dispensing slot, a storage compartment comprised of front, rear and side panels, and a lid comprised of front and side lid edges; wherein the dispensing slot traverses the front panel; and wherein the upper edges of the side front and rear panels form an opening of the storage compartment that engages with the lid at an angle beneath the upper edges of the side panels of the storage compartment wherein the front and side lid edges move from a position above the upper edges of the side panels to a position below the upper edges of the side panels;

b. a dispensing element comprised of at least one movable dispensing element housed within the base, a motor assembly and a power source; wherein the at least one movable dispensing element, upon activation of the motor assembly, consecutively engages with the surface bill of a stack of bills in the storage compartment and moves it in a forward trajectory toward the dispensing slot such that the bill is dispensed in a projectile manner from the dispensing slot; and c. a handle located beneath the base which houses the power source, with an actuation means for activating the motorized dispensing element; wherein engagement of the actuation means activates the motor assembly and initiates the motion of the movable dispensing element to dispense the bills from the dispensing slot.

2. The projectile dispenser apparatus of claim 1 further comprising a safety that extends across the dispensing slot when the actuation means is not engaged, and retracts vertically beneath the opening of the dispensing slot when the actuation means is engaged.

3. The projectile dispenser apparatus of claim 2 wherein the safety is moved at an angle upon actuation of the switch.

4. The projectile dispenser apparatus of claim 1 wherein the at least one movable dispensing element is a roller.

5. The projectile dispenser apparatus of claim 1 wherein the actuation means provides a continuous rotation of the at least one movable dispensing element when it is engaged and is selected from a push button switch or a trigger assembly.

6. The projectile dispenser apparatus of claim 1 wherein the actuation means is a switch.

7. The projectile dispenser apparatus of claim 1 further comprising a light feature that flashes upon activation of the power source.

8. The projectile dispenser apparatus of claim 1 further comprising an audio feature that generates a sound upon activation of the power source.

9. The projectile dispensing apparatus of claim 1 wherein the bills are selected from currency, coupons, handbills or other flexible planar materials.

10. A method of rapidly dispensing multiple bills in projectile fashion comprising the steps of:

a. inserting multiple bills in the storage compartment of a projectile dispenser apparatus comprised of a base, a handle and an actuation means; wherein the base comprises:

i. a storage compartment for holding the multiple bills;

ii. a dispensing slot further comprising a safety that extends across the dispensing slot when the actuation means is not engaged, and which retracts vertically when the actuation means is engaged;

iii. a compartment for housing a movable dispensing apparatus and motor assembly;

iv. a movable dispensing apparatus for moving the bills toward and through a dispensing slot;

v. a motor assembly for activating movement of the movable dispensing apparatus; and and wherein the handle includes a power source; and further wherein the power source, the motor assembly and the actuation means comprising an electrical circuit that is activated by the initiation of the actuation means;

b. pointing the apparatus at a desired target;

c. applying manual pressure on the actuation means to activate the electrical circuit and provide electrical power to the motor assembly and retract the safety; and d. dispensing the bills toward the target.

11. The method of claim 10 further comprising modulating the rate of dispensing and the flow of bills being dispensed by increasing or decreasing manual pressure on the actuation means.

12. The method of claim 10 wherein the movable dispensing apparatus includes a roller.

13. The method of claim 10 wherein the actuation means is a trigger assembly.

14. The method of claim 10 wherein the actuation means is a push button switch.

* * * * *